United States Patent [19]

Bittinger

[11] 4,137,895

[45] Feb. 6, 1979

[54] DRAFT DEVICE FOR FIREPLACE

[76] Inventor: Raymond W. Bittinger, 506 Franklin St., Carlisle, Pa. 17013

[21] Appl. No.: 827,010

[22] Filed: Aug. 23, 1977

[51] Int. Cl.[2] ..... F24B 1/18

[52] U.S. Cl. ..... 126/120; 126/163 R; 126/288

[58] Field of Search ..... 126/120, 288, 285.5, 126/121, 201, 202, 203, 163 R, 164, 122, 123, 140, 138, 126, 154, 298

[56] References Cited

U.S. PATENT DOCUMENTS

| | | | |
|---|---|---|---|
| 2,103,171 | 12/1937 | Nilson | 126/120 |
| 2,409,731 | 10/1946 | Bolinger | 126/120 |
| 2,497,486 | 2/1950 | Barber | 126/120 |
| 3,096,754 | 7/1963 | Howrey | 126/120 |

*Primary Examiner*—Dennis L. Taylor

*Attorney, Agent, or Firm*—Cameron, Kerkam, Sutton, Stowell & Stowell

[57] ABSTRACT

A fireplace draft device introduces outside air along the front edge of the fireplace firebox and the induced air is so distributed that the major portion of air flow is adjacent the ends of the front edge thereby encouraging more uniform burning of the fireplace fuel. The draft introducing device is also provided with means which cooperates with the conventional fireplace damper to control the volume of induced air.

4 Claims, 4 Drawing Figures

Fig 1.
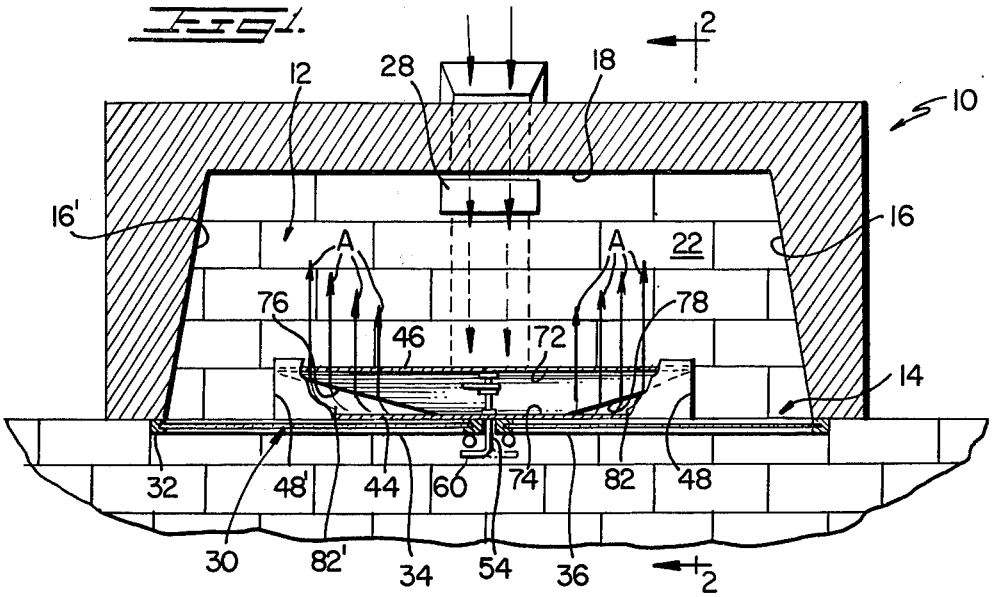
Fig 3.
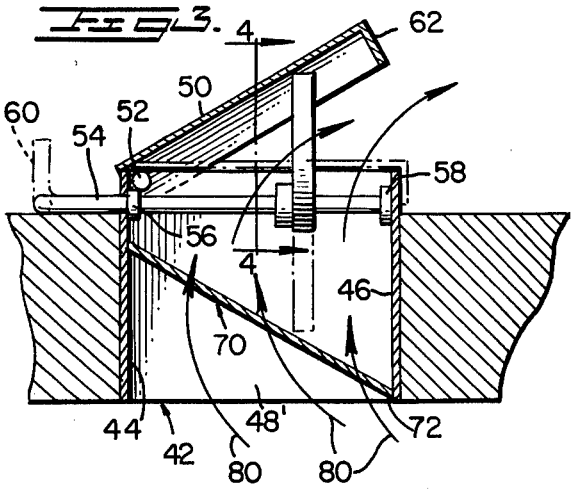
Fig 2.
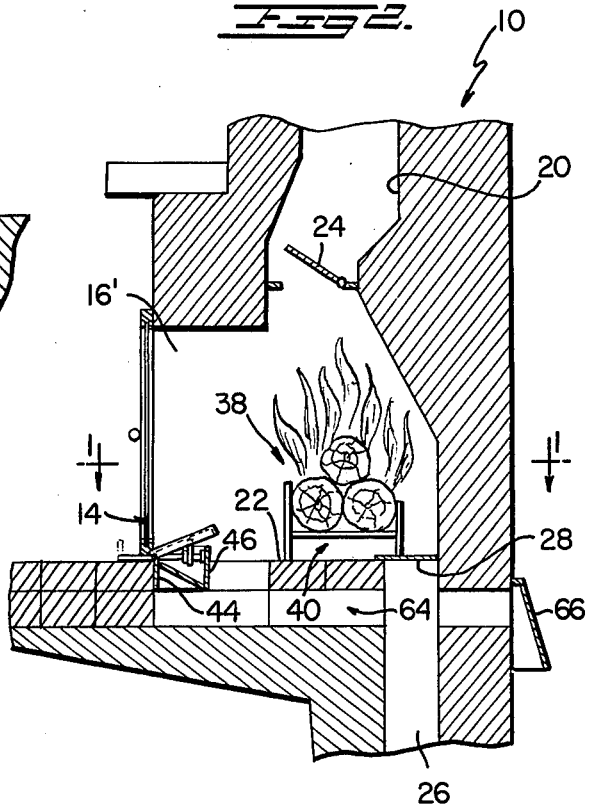
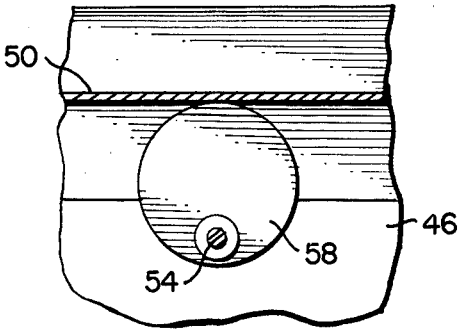
Fig 4.

DRAFT DEVICE FOR FIREPLACE

BACKGROUND OF THE INVENTION

1. Field of the Invention

The invention is directed to improved means for introducing in a controlled manner combustion air into the combustion chamber of a fireplace.

In present day dwellings, weather stripping and storm windows and doors render it very difficult to provide sufficient combustion air for proper operation of fireplaces, thereby often necessitating the opening of doors or windows to permit entrance of combustion air. Opening of doors or windows often defeats the usefulness of fireplaces as such openings produce undesirable cold drafts in the room to be heated and is wasteful of energy which is expensive and of short supply thereby often defeating the economic advantages of fireplace operation.

2. Description Of The Prior Art

It is known to provide combustion air for fireplaces from sources outside of the immediate room containing the fireplace and to provide means for regulating the flow of air from such secondary sources. Certain of such devices are characterized by the structures depicted in U.S. Pat. Nos. 2,470,430 to Carter; 2,375,318 to Mudgett; 2,740,398 to Collins; and 3,976,048 to Ashman, Jr.

While the devices of such prior art patents ably provide combustion air for the fuel in a fireplace, such structures often result in uneconomical and non-uniform combustion, again partially defeating the economic advantages of fireplace operation.

SUMMARY OF THE INVENTION

The present invention is directed to an improved fireplace draft inducing means having an air equalizing baffle which prevents the free flow of air from concentrating in the center of the fireplace hearth by inducing the air to flow to the left and to the right of the center of the conbustion area.

It is a further object of the present invention to provide such a device with an air flow controlling lid which in conjunction with the fireplace damper is effective to regulate the volume of combustion air to thereby encourage uniform and controlable fuel comsumption.

It is a further object to provide a fireplace draft inducing and equalizing means wherein the combustion air is provided from a source remote from the room containing the fireplace.

Another object is to provide such a fireplace draft equalizing means which may be readily installed in new constructions and employable in existing fireplaces without substantial modifications of existing fireplaces.

Another object of the invention is to provide such a draft equalizing means having particular utility with fireplaces having a glass enclosed fireplace opening.

The invention may be generally defined in combination with a fireplace having an open front, combustion chamber and side and back walls, hearth, and chimney flue; draft introducing means, the draft introducing means comprising a plenum chamber extending along the front edge of the fireplace hearth, the plenum chamber having an open upper surface communicating with the combustion chamber, a pivotal lid for the open upper surface, actuator means for the lid, a transverse duct below the hearth communicating at one end with the plenum chamber and at the other end with ambient atmosphere remote from the plenum chamber, a baffle plate in the plenum chamber, the baffle plate being shaped such that air flow from the open upper surface of the plenum chamber is at a maximum at the ends of the chamber and gradually decreases to zero flow at the center of the plenum chamber.

BRIEF DESCRIPTION OF THE DRAWING

FIG. 1 is a fragmentary sectional view on line 1—1 of FIG. 2 illustrating an embodiment of the present invention;

FIG. 2 is a section on 2—2 of FIG. 1;

FIG. 3 is an enlarged partially sectional view of the plenum chamber, lid actuating means, and baffle therefor; and FIG. 4 is an enlarged fragmentary end view on line 4—4 of FIG. 3.

DESCRIPTION OF THE PREFERRED EMBODIMENT

Referring to the drawing, 10 generally designates a fireplace consisting of a combustion chamber 12 having an open front wall 14, sidewalls 16 and 16', a back wall 18, a flue 20 and a hearth 22. The fireplace also includes a flue damper 24 of conventional design, a passage 26 leading to an ash pit (not shown) which passage is provided with a openable or removable closure member 28.

In the illustrated form of the invention, the fireplace 10 is provided with a front glass enclosure generally designated 30, which glass enclosure includes a peripheral frame 32 and a pair of doors 34 and 36 hingedly mounted thereto. The present invention comprises means for directing in a controlled pattern combustion air to the fuel 38, illustrated as logs supported on a cradle or grate 40. The air directing means comprises a plenum chamber generally designated 42 constructed as a quadrangular box having front wall 44, rear wall 46 and end walls 48 and 48'. The top and bottom of the box 42 are open. The open top of the plenum chamber 42 is provided with a hinged cover generally designated 50. The hinge line for the cover being the along the front edge and comprising hinge pin 52 carried by the side walls of the plenum chamber 48 and 48'.

An actuator for the lid 50 comprises a shaft 54 mounted for rotation in bearings 56 and 58 carried by the front and rear walls 44 and 46 respectively. The shaft has secured thereto an eccentrically mounted actuator 58. Further, the shaft 54 has a handle 60 projecting outwardly from the front wall 44 of the plenum chamber whereby, when the handle 60 is rotated, the eccentrically mounted actuator 58 causes the rearward end 62 of the lid 50 to move from the closed position shown by broken lines in FIG. 3 to the open position shown in full lines in FIG. 3, thereby effectively controling the volume of air introduced into the firebox 22 of the fireplace 10 in conjunction with the controlable damper 24 in the flue 20.

Air is directed to the plenum chamber 42 by a transverse passage generally designated 64 which extends below the hearth 22 to the ambient atmosphere outside of the dwelling. The end of the duct 64 communicating with the outside of the dwelling is provided with a hooded cover or protector 66 to prevent the entrance of water, snow, animals and the like into the passage 64. The lower end of the hood 66 may be provided with a wire mesh, screening and the like (not shown).

From the the foregoing description, it will be seen that means are provided for directing ambient air from outside of the room enclosing a fireplace to the combustion chamber of the fireplace; however, the device as described would result in a flow path of the air basically to the center of the fireplace resulting in non-uniform combustion of the fuel 38 and non-uniform heat distribution within the combustion chamber. In order to overcome such non-uniform fuel consumption, there is provided within the plenum chamber 42 a baffle member generally designated 70. The baffle member 70, as more clearly shown in FIGS. 1, 2 and 3, comprises a plate in the shape of a trapezoid with the rearward edge 72 thereof extending in full length of the back wall 46. The front wall or edge 74 of the baffle plate 70 has a length no greater than about ⅓rd the length of the front wall 44 and a pair of sloping edges 76 and 78, which edges join the front 74 and the rear 72 edges to describe a regular trapezoid.

The baffle is also sloped from wall 46 upwardly to wall 44 to provide for a smooth transition of airflow as depicted by airflow arrows 80, FIG. 3 of the drawings. With the baffle 70 in place, there is defined two triangular airflow passage 82 and 82', more clearly shown in FIG. 1 of the drawings with the greatest height of the triangle being adjacent the end walls 48 and 48' of the plenum chamber. With airflow passages as described, air entering the combustion chamber 22 is greatest adjacent opposite end walls of the plenum chamber and slowly decreasing to zero airflow in the zone of edge 74 of the baffle 70.

The flow arrows A (FIG. 1) have lengths corresponding to the volume of flow from the plenum chamber 42 into the combustion chamber 12, thus it will be seen from the flow arrows that the combustion air is directed basically toward the ends of the fuel 38 with a decreasing flow toward the center of the fire which encourages the fire to burn more slowly and more uniformly allowing better radiation of heat with less fuel consumption.

From the foregoing description, it will be seen that, with a prefabricated plenum chamber 42 and hood 46 in original constructions, a portion of the first course of bricks in the hearth is omitted and the plenum chamber 42 is inserted therein. Similarly, an undercourse of bricks is omitted to provide the passage 64. In old constructions, it is necessary to remove the already installed portion of the first row of hearth bricks and to remove sufficient masonry to provide the channel 64.

It will be appreciated that, where the fireplace is not adjacent an external wall, the passage 64 may be connected to the outside ambient atmosphere via a plastic or metal conduit or the plenum chamber may be fed by a duct connecting, for example, a basement or crawl space area below the fireplace 10, all as will be appreciated by those skilled in this art.

Exemplary of the present invention, very satisfactory results have been obtained when the length of the plenum 42 is 30 inches and its width is 4 inches. With a plenum chamber of this configuration, the edge 74 of the baffle 70 would be from about 30 to about 12 inches long.

Having described a preferred embodiment of the present invention, it will be appreciated that various modifications may be made therein without departing from the scope of the present invention.

I claim:

1. In combination with a fireplace having an open front combustion chamber and side and back walls, hearth, and chimney flue, of draft introducing means, said draft introducing means comprising a plenum chamber extending solely along the front edge of the fireplace hearth, said chamber having an open upper surface communicating with the combustion chamber, a lid for the open upper surface, pivot means mounting said lid to the front edge of the plenum chamber, actuator means for said lid, a transverse duct below said hearth communicating at one end with the plenum chamber and at the other end with ambient atmosphere remote from the plenum chamber, a baffle plate in said plenum chamber, said baffle plate being shaped such that airflow from the open upper surface of the plenum chamber is at a maximum at the ends of the chamber and gradually decreases to zero flow at the center of the plenum.

2. The invention defined in claim 1 wherein the baffle plate is in the shape of a regular trapezoid with the smaller of the parallel edges thereof positioned along the front wall of the plenum chamber and the larger of the parallel edges being in contact with the rearward wall of the plenum chamber.

3. The invention defined in claim 2 wherein the larger of the parallel edges of the baffle is in contact with the rearward wall of the plenum chamber and coextensive therewith.

4. The invention defined in claim 1 wherein the baffle is in the shape of a regular trapezoid and defines with the walls of the plenum chamber a pair of triangular air flow passages.

* * * * *